US007541545B2

(12) United States Patent
Varkey et al.

(10) Patent No.: US 7,541,545 B2
(45) Date of Patent: Jun. 2, 2009

(54) TAPELESS CABLE ASSEMBLY AND METHODS OF MANUFACTURING SAME

(75) Inventors: Joseph Varkey, Missouri City, TX (US); Byong Jun Kim, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/565,397

(22) Filed: Nov. 30, 2006

(65) Prior Publication Data

US 2008/0128152 A1 Jun. 5, 2008

(51) Int. Cl.
*H01B 7/08* (2006.01)

(52) U.S. Cl. ..... 174/117 F

(58) Field of Classification Search ..... 174/117 F, 174/117 FF, 115

See application file for complete search history.

(56) References Cited

U.S. PATENT DOCUMENTS

| | | | | | |
|---|---|---|---|---|---|
| 4,440,974 | A | | 4/1984 | Naudet | |
| 5,086,196 | A | | 2/1992 | Brookbank | |
| 5,371,325 | A | * | 12/1994 | Kalola et al. | 174/117 F |
| 5,495,547 | A | | 2/1996 | Rafie | |
| 5,552,565 | A | * | 9/1996 | Cartier et al. | 174/117 F |
| 6,057,511 | A | * | 5/2000 | Ikeda et al. | 174/110 R |
| 6,060,662 | A | | 5/2000 | Rafie | |
| 6,195,487 | B1 | | 2/2001 | Anderson | |
| 6,201,191 | B1 | | 3/2001 | Yorita | |
| 6,236,789 | B1 | | 5/2001 | Fitz | |
| 6,392,155 | B1 | * | 5/2002 | Shimizu et al. | 174/117 F |
| 6,403,889 | B1 | | 6/2002 | Mehan | |
| 6,924,436 | B2 | | 8/2005 | Varkey | |
| 7,009,113 | B2 | | 3/2006 | Varkey | |
| 7,119,283 | B1 | | 10/2006 | Varkey | |
| 7,170,007 | B2 | | 1/2007 | Varkey | |
| 7,188,406 | B2 | | 3/2007 | Varkey | |
| 7,200,305 | B2 | | 4/2007 | Dion | |
| 7,235,743 | B2 | | 6/2007 | Varkey | |
| 7,371,967 | B2 | * | 5/2008 | MaHoney et al. | 174/117 F |
| 2005/0016753 | A1 | * | 1/2005 | Seigerschmidt | 174/106 R |
| 2005/0285754 | A1 | * | 12/2005 | Hall et al. | 340/855.1 |

FOREIGN PATENT DOCUMENTS

| | | | |
|---|---|---|---|
| DE | 4004229 | * | 8/1991 |
| EP | 97414 | * | 1/1984 |
| JP | 492110 | | 3/1992 |
| WO | 2004049030 | | 6/2004 |
| WO | 2006070314 | | 7/2006 |

* cited by examiner

*Primary Examiner*—Chau N Nguyen
(74) *Attorney, Agent, or Firm*—Michael Flynn; David Cate; Jaime Castano

(57) ABSTRACT

The present invention relates to methods of manufacturing tapeless cable assemblies. The methods generally include providing a plurality of adjacent conductor cables, followed by applying a cross-linkable first material around the plurality of conductor cables and in the interstitial openings occurring between the cables. Cross-linking can be initiated by applying a second material which facilitates cross-linking of the first material or by other means such as exposing the material to ultraviolet radiation. The wrapped assembly is then welded to form a core assembly. The disclosed manufacturing methods do no require a tape, thereby shortening the manufacturing process and reducing the manufacturing costs.

4 Claims, 3 Drawing Sheets

TAPELESS CABLE ASSEMBLY AND METHODS OF MANUFACTURING SAME

FIELD

The present disclosure relates generally to electrical cabling, and more particularly to electrical cable assemblies and methods of manufacturing the same.

BACKGROUND

The statements in this section merely provide background information related to the present disclosure and may not constitute prior art.

A conventional electrical cable generally includes a bundle of insulated wires/conductors and an insulating layer surrounding and binding the insulated conductors, thereby forming a core assembly. The core assembly may be further surrounded by a protective jacket or armor wires to provide mechanical strength to the core assembly.

The insulating layer that surrounds the bundle of insulated conductors must fill in the interstitial openings defined between the insulated conductors to prevent air or other gases trapped therein, which may be ionized by an electrical field during use and thus impair the performance of the electrical cable. Additionally, the insulating layer is generally formed of a material having the properties of incompressibility, wear resistance, and heat-resistance in order to protect the insulated conductors therein during manufacturing and use.

A conventional method of manufacturing the electrical cable requires a step of applying an insulating material around the insulated conductors in a liquid form to allow the insulating material to flow into and fill the interstitial openings to form the insulating layer. A helical tape is then wrapped around the bundle of insulated conductors and the insulating material to hold the same in place when the insulating material is still wet until a further manufacturing process that solidifies the insulating material is performed. After the insulating material is solidified to form a solid insulating layer, the tape serves no function in the completed core assembly.

The use of a tape in the cabling process has some disadvantages. First of all, the tape increases manufacturing cost and serves no substantial function to the completed electrical cable, except as a manufacturing aid. Second, wrapping the tape is burdensome and time consuming, thereby prolonging the manufacturing process. Third, improper wrapping of the tape may introduce undesirable stress to and damage the insulated conductors enclosed therein. Finally, the tape itself may be susceptible to hydrolysis in water at temperature above about 80° C.

SUMMARY

Embodiments of the present invention provide methods of manufacturing tapeless cable core assemblies for ease of manufacturing. In one preferred form, a method of manufacturing a cable assembly comprises providing a plurality of adjacent conductor cables having interstitial openings therebetween; applying a cross-linkable first material around the plurality of conductor cables and in the interstitial openings; and causing cross-linking of the first material to form a core assembly.

In another preferred form, a cable assembly is provided that comprises a plurality of adjacent conductor cables having interstitial openings therebetween and an insulating material disposed around the plurality of conductor cables and filling in the interstitial openings. The insulating material comprises a cross-linkable first material and a second material. The second material is effective to cause cross-linking of the first material to form a core assembly.

In yet another preferred form, a method of manufacturing a cable assembly comprises applying an insulating material over a plurality of conductor cables arranged side by side adjacent to each other to form a sheet assembly, the sheet assembly having first and second ends and opposing first and second surfaces; placing at least one central conductor cable in proximity to the first surface of said sheet assembly; and wrapping the sheet assembly around the at least one central conductor cable to enclose the central conductor therein to form a core assembly.

In still another preferred form, a preformed sheet assembly is provided, which is adapted to surround a central conductor cable to form a core assembly. The preformed sheet assembly comprises a plurality of outer conductor cables arranged side by side adjacent each other. An insulating material is disposed around the outer conductor cables to enclose the plurality of conductor cables therein. The insulating material defines opposing first and second surfaces, wherein the first surface is adapted to contact the central conductor and the second surface is adapted to form an outer circumference of the core assembly.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
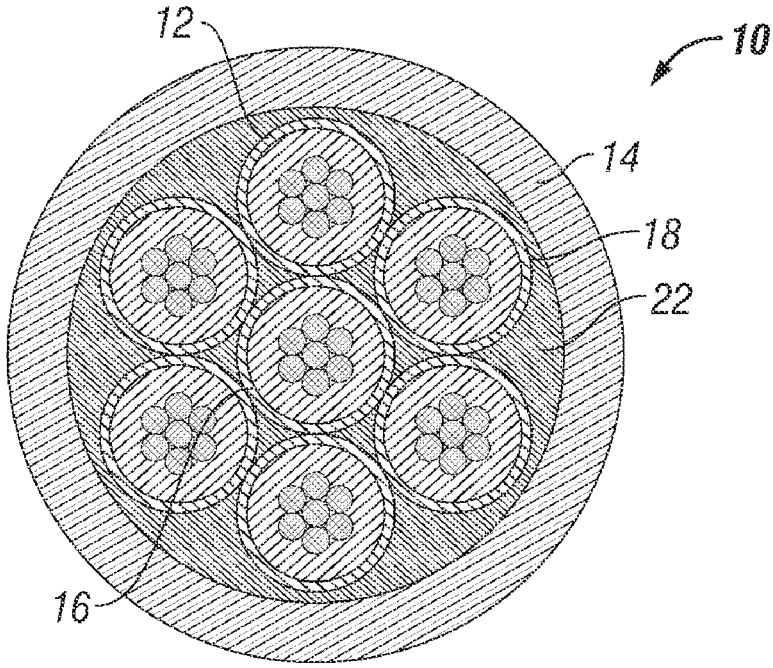
FIG. 1 is a cross-sectional view of a cable assembly constructed in accordance with the teachings of the present disclosure.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. While the embodiments of the present invention are described herein as comprising certain materials, it should be understood that the composition could optionally comprise two or more different materials. In addition, they can also comprise some components other than the ones already cited. The following description is merely exemplary in nature and is not intended to limit the present disclosure, application, or uses. It should be understood that throughout the drawings, corresponding reference numerals indicate like or corresponding parts and features.

Figure 2:
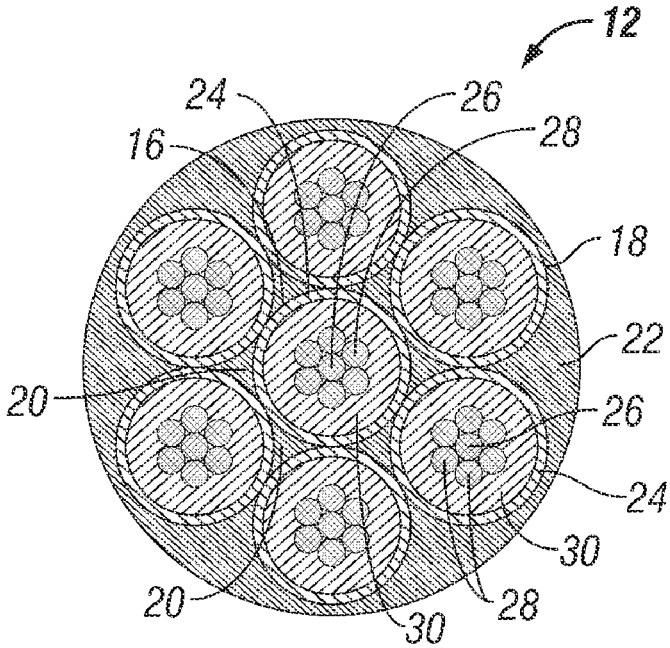
FIGS. 2 is a cross-sectional view of a core assembly of the cable assembly of FIG. 1.

Referring to FIGS. 1 and 2, a cable assembly constructed in accordance with the teachings of the present disclosure is illustrated and generally indicated by reference numeral 10. The cable assembly 10 comprises a core assembly 12 and an optional protective jacket 14 surrounding the core assembly 12. When used, the protective jacket 14 may be made of plastic, polymer, or metal, depending on applications. While not shown in the drawings, an additional insulating layer may be disposed between the core assembly 12 and the protective jacket 14 to provide further insulation. Alternatively, in other embodiments of the invention, the protective jacket 14 may be replaced by armor wires (not shown), or armor wires may be layered adjacent the peripheral surface of protective jacket 14, or even armor wires may be partially or fully encased within protective jacket 14.

As clearly shown in FIG. 2, the core assembly 12 includes a central conductor cable 16 and a plurality of outer conductor cables 18 disposed around the central conductor cable 16. The central conductor cable 16 and the outer conductor cables 18 are adjacent to define a plurality of interstitial openings 20 therebetween. An insulating material 22 is disposed around the outer conductor cables 18 and in the interstitial openings 20 to insulate the central conductor cable 16 and the outer conductor cables 18. The insulating material 22 includes a cross-linkable first material, a second material that causes cross-linking of the first material, and optionally a plasticizer.

Any suitable cross-linkable material, and material that causes cross-linking, may be used in accordance with the invention. As used herein, the term "cross-linking" means forming covalent bonds linking one polymer chain to another, and is the characteristic property of thermosetting plastic materials. Crosslinking inhibits close packing of the polymer chains, thus preventing the formation of crystalline regions. Cross-links are formed by chemical reactions that are initiated by adequate energy (i.e. heat, UV radiation, IR radiation, and the like) and/or pressure, or by the mixing of an unpolymerized or polymerized resin with various chemicals. Also, cross-linking can be induced in materials that are normally thermoplastic through exposure to radiation. In most cases, cross-linking is irreversible, and the resulting thermosetting material will degrade or burn if heated, without melting. As a nonlimiting example of cross-linking, the chemical process of vulcanization is a type of cross-linking and it changes the property of rubber to the hard, durable material. Accelerators increase the rate of cure by catalyzing the addition of sulfur chains to the rubber molecules. Other types of cross-linked polymers are those made by addition of peroxide during extruding (type A) or by addition of a cross-linking agent (e.g. vinylsilane) and a catalyst during extruding and then performing a post-extrusion curing. Cross-linking may also be achieved by physical means. For example, electron beams are used to cross-link the C type of cross-linked polyethylene.

Referring again to FIGS. 1 and 2, the central conductor cable 16 and the outer conductor cables 18 each include an optional inner insulation jacket 24, an insulated central conductor 26, and a plurality of insulated outer conductors 28 surrounding the insulated central conductors 26. A filler material 30 fills in the space defined by the inner insulation jacket 24, the insulated outer conductors 28 and the insulated central conductor 26. The insulated central conductor 26 can be internally axially aligned with the insulated outer conductors 28. Alternatively, the insulated outer conductors 28 can be disposed in a helical manner relative to the insulated central conductor 26. In some instances, the optional inner insulation jacket 24 may be formed of a material softer (durometer <50 ShoreA) than the filler material 30, vice versa, or filler material 30 and insulation jacket 24 may have similar softness/hardness properties.

In FIGS. 1 and 2, one central conductor 16 and six outer conductor cables 18 are shown to be adjacent to form a substantially circular core assembly 12 in cross-section. It should be noted that the number of conductor cables 16 and 18 and the configuration of the core assembly 12 and the cable assembly 10 may vary depending on applications. For example, more than one central conductor 16 may be used to form a core assembly 12 with a larger cross-section. Moreover, the central conductor cable 16 and the outer conductor cables 18 may be so arranged to define a core assembly 12 with a substantially rectangular cross-section. Other configurations are possible without departing from the spirit of the present disclosure.

Figure 3:
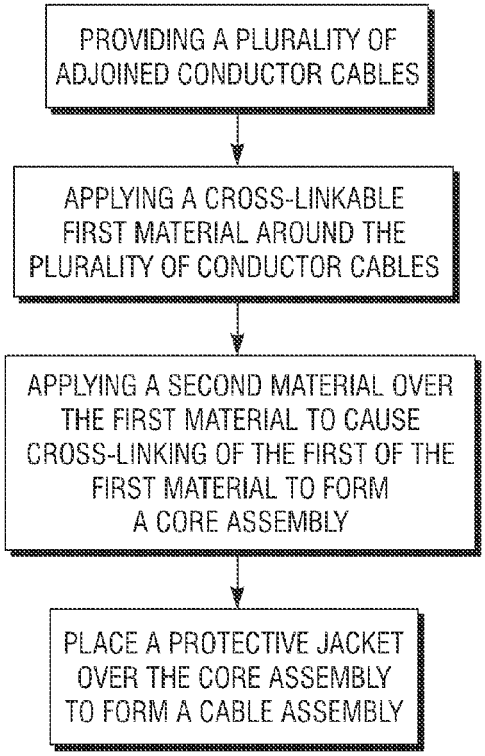
FIG. 3 is a schematic flow diagram of a first illustrative method of manufacturing the cable assembly of FIG. 1.
Figure 4:
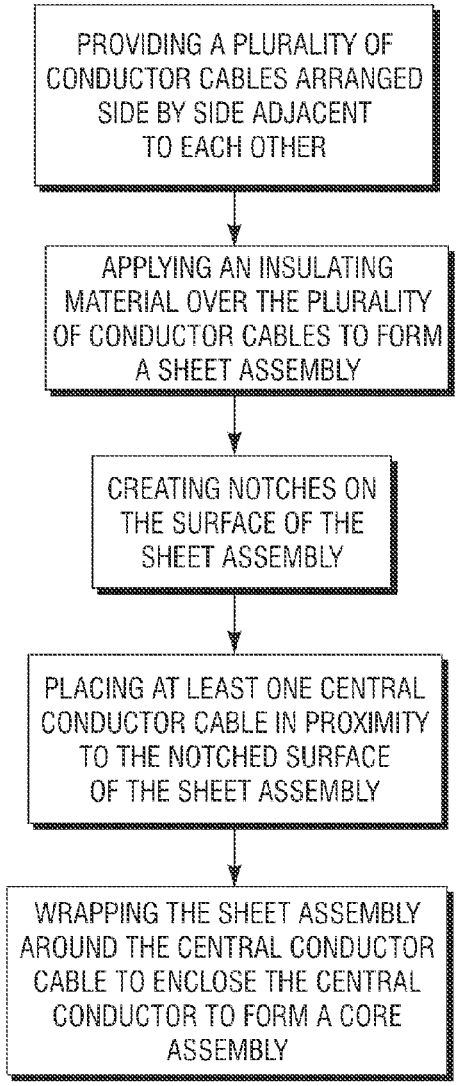
FIG. 4 is a schematic flow diagram of a second illustrative method of manufacturing the cable assembly of FIG. 1.

Referring to FIG. 3, a first illustrative method of manufacturing the cable assembly 10 of FIG. 1 is now described in more detail. First, a plurality of conductor cables 16 and 18 are provided and adjacent to define a plurality of interstitial openings 20. Then, the insulating material 22 is applied around the adjacent central conductor cable 16 and the outer conductor cables 18 to form the core assembly 12.

In one embodiment of the invention, application of the insulating material 22 generally involves a two-stage process. First, the cross-linkable first material is applied over the adjacent conductor cables 16 and 18 in a liquid form by any suitable technique, such as, but limited to, extrusion. The cross-linkable first material is so prepared that it has a viscosity small enough to allow the first material to flow into and substantially fill in the interstitial openings 20 to eliminate voids. If necessary, plasticizers may be incorporated into the first material before applying the first material around the conductor cables 16 and 18 to optimize viscosity and control flowing of the first material into the interstitial openings 20.

Second, after the first material is applied around the outer conductor cables 18 to form an insulating layer having a predetermined thickness that provides sufficient insulation for the conductor cables 16 and 18, the first material is cross-linked to solidify the first material to form a solid core assembly 12. Cross-linking can be affected by chemical and/or physical reaction. For example, a second material, which is a cross-linking agent, may be applied over the first material which causes cross-linking of the first material and solidifies the first material to form a solid core assembly 12.

In another embodiment of the invention, application of the insulating material 22 generally involves a one-stage process where the cross-linkable first material and second cross-linking agent are premixed and applied over the adjacent conductor cables 16 and 18 in a liquid form by any suitable technique. The premixture is so prepared that it has a viscosity low enough to allow adequate flow. If necessary, plasticizers may be incorporated into the mixture. As a further optional step, after the first material is applied around the outer conductor cables 18 to form an insulating layer, a second material, which is a cross-linking agent, may be applied over the first material which further optimizes cross-linking of the first material and solidifies the first material to form a solid core assembly 12.

Any suitable thermoset material or cross-linkable thermoplastic material may be used as the first material according to the invention. Preferably, the materials are low shrinkage materials when cooled. In some embodiments, the first material is a polyolefin elastomeric material, such as, by nonlimiting example, elastomer sold under the trademark Engage® by DuPont™ Company. Engage® is available in grades that melt at temperature of 100° C. or slightly lower. Since Engage® has a high viscosity at about 100° C., when Engage® is used, it is preferable that plasticizers are added to reduce its viscosity to enable Engage® to flow more readily into the interstitial openings 20. Once cross-linked, Engage® can withstand short-term exposure to temperatures up to 250° C. Other nonlimiting examples of materials useful as the first material include those based upon polyethylene, polyphenyl sulfide, thermoplastic vulcanizates (such as DuPont™ ETPV, Dow Corning TPSiV™, Teknor Apex Uniprene XL, Zeon Chemicals L. P. (Zeotherm™), polyurethanes (such as Sanprene® manufactured by Sanyo Chemical Industries, Ltd), ethylene-propylene-diene-monomer (EPDM) based polymers, Parmax, polyetheretherketone (PEEK), polyetherketone (PEK), Parmax® SRP polymers (self-reinforcing polymers manufactured by Mississippi Polymer Technologies, Inc based on a substituted poly (1,4-phenylene) structure where each phenylene ring has a substituent R group derived from a wide variety of organic groups), polytetrafluoroethylene-perfluoromethylvinylether polymer (MFA), perfluoroalkoxyalkane polymer (PFA), polytetrafluoroethylene polymer (PTFE), ethylene-tetrafluoroethylene polymer (ETFE), ethylene-propylene copolymer (EPC), poly(4-methyl-1-pentene) (TPX® available from Mitsui Chemicals, Inc.), polypropylene based polymers, fluorinated ethylene propylene based polymers, ethylene-tetrafluoroethylene polymers (Tefzel®), and the like, as well as any combinations thereof. Optionally, the first material may be amended with a fiber or particle. The filler material 30 of FIGS. 2 and 3 may be composed of any of the above materials, as well as any filler material commonly known to those of skill in the art.

The second material may be any cross-linking agent which serves, either directly or indirectly, to form covalent bonds linking polymer chains of the first material. Preferably, the crosslinking agent be selected from the group consisting of peroxides, silanes based compounds, sulfur containing compounds, carbon black, and the like, or combinations thereof.

As noted above, the cross-linking of the first material does not have to be achieved by a chemical means. Alternatively, the cross-linking can be achieved by exposing the first material to ultraviolet radiation by way of non-limiting example.

After the core assembly 12 is completed, the protective jacket 14 is placed around the core assembly 12. The protective jacket 14 may be made of plastic or metal to provide mechanical strength to the core assembly 12 or to achieve other purposes known in the art. Since placing a protective jacket 14 around the core assembly 12 is known in the art, the description thereof is omitted herein for clarity. Before placing the protective jacket 14, it is possible to form an additional insulation layer around the core assembly 12.

Figure 5:
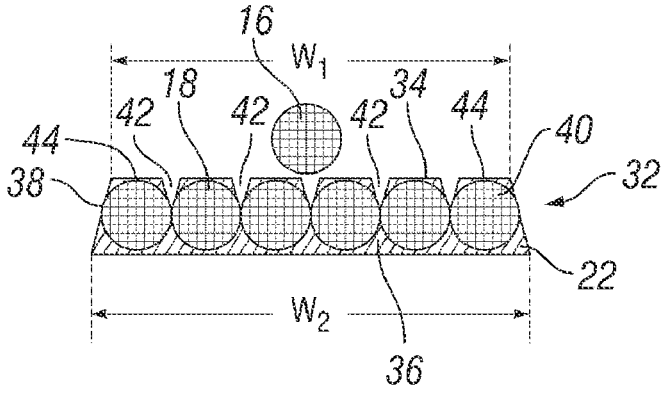
FIGS. 5, 6 and 7 are cross-sectional views of the core assembly of FIG. 2, illustrating sequential steps of manufacturing the core assembly in accordance with the second illustrative method.
Figure 6:
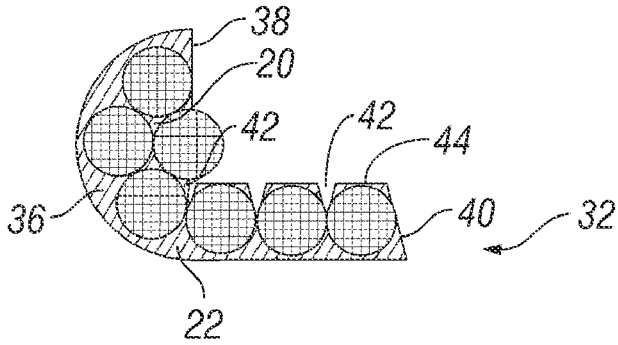
Figure 7:
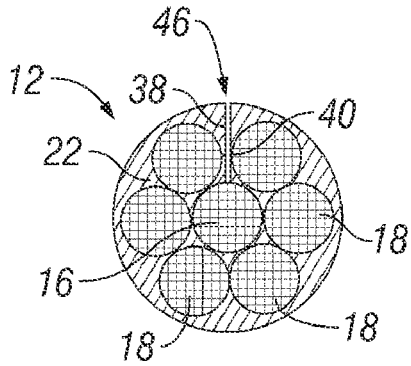

Referring to FIGS. 4 to 7, a second illustrative method of manufacturing the cable assembly 10 is now described. In FIGS. 5 to 7, the insulated conductors 26 and 28 disposed within the conductor cables 16 and 18 are removed for clarity. The central conductor cable 16 and the outer conductor cable 18 may be a single insulated conductor as shown in FIGS. 5-7 or may include a bundle of insulated conductors 26 and 28 surrounded by an inner insulation jacket 24 as shown in FIGS. 1 and 2.

As clearly shown in FIG. 5, the outer conductor cables 18 are first arranged side by side adjacent to each other. Next, the insulating material 22 is applied over the outer conductor cables 18 to form a preformed sheet assembly 32. Preferably, the insulating material 22 is applied by extrusion. Depending on the method of applying the insulating material 22, the preformed sheet assembly 32 may require trimming to achieve a predetermined shape suitable for the next manufacturing step. The preformed sheet assembly 32 preferably includes a first surface 34, a second surface 36, a first end 38, and a second end 40, which define a substantially trapezoid cross-section as shown in FIG. 5. The first surface 34 has a width W1 smaller than the width W2 of the second surface 36.

The first surface 34 has a plurality of notches 42, which may be formed by any suitable technique, such as cutting, grinding, molding, displacement during extrusion, and the like. Preferably, the notches 42 are formed between two adjacent outer conductors 18 to define a plurality of contacting portions 44 therebetween. As a result, the first surface 34 is formed by a plurality of notches 42 and contacting portions 44 arranged in an alternate manner along the width W1 of the first surface 34. The notches 42 are constructed so that the total width of the contacting portions 44 is substantially equal to the outer circumference of the central conductor cable 16 to be surrounded by the preformed sheet assembly 32.

Thereafter, the central conductor cable 16 is placed in proximity to the first surface 34 of the sheet assembly 32. The sheet assembly 32 is then wrapped around and encloses the central conductor cable 16. As the sheet assembly 32 is wrapped, the contacting portions 44 of the first surface 34 of the sheet assembly 32 are in contact with the outer circumference of the central conductor cable 16 and the notches 42 are closed because of engagement between the adjacent two contacting portions 44. When the wrapping process is completed, all the notches 42 are essentially closed and all the contacting portions 44 are in contact with the outer circumference of the central conductor cable 16.

When placed in proximity to the first surface 34 of the sheet assembly 32, the central conductor cable 16 can be oriented parallel to or at an angled relative to a longitudinal axis of the sheet assembly 32 (or the axes of the outer conductor cables 18). When the central conductor cable 16 is placed at an angle relative to the longitudinal axis of the sheet assembly 32, the resulting core assembly 12 will be a helical core assembly with the outer conductor cables 18 helically wrapped around the central conductor cable 16 at the same angle.

As further shown in FIG. 7, after the wrapping process is completed, a seam 46 is found between the first end 38 and the second end 40 along the length of the sheet assembly 32. By welding the first end 38 and the second end 40, the sheet assembly 32 is maintained in a wrapped state, thereby completing a solid core assembly 12.

Alternatively, individual outer conductor cables 18 may have the insulating material 22 is applied thereupon to form keystone cross-sectioned shapes, and then a plurality of such insulated conductors are arranged adjacent one another around a central conductor 16. The keystone shaped insulated conductors fit tightly against each other and over the central conductor 16 to at least substantially eliminate interstitial spaces, and create a cable core assembly 12 with a circular cross-sectional profile. Fiber may be incorporated with insulating material 22 to provide a low-warpage-effect, fiber-reinforced polymer which is capable of holding shape during temperature change.

Preferably, after the core assembly 12 is formed, the core assembly 12 is annealed above the glass transition temperature of the insulating material 22 to eliminate or reduce the residual stress in the core assembly 12.

The insulating material 22 used in the second illustrative manufacturing methods includes any of rubbers, thermoplastics or thermoplastic elastomers, as well as any of those materials described as the first material in the embodiments illustrated by FIGS. 1 through 3. Optionally, in conjunction with the insulating material, a cross-linking agent may be used, such as the second material of the embodiments illustrated by FIGS. 1 through 3. Preferably, the insulating material 22 is a low-molecular-weight thermoplastic or a low-molecular-weight thermoplastic elastomer. The preferred material is Engage®.

While only one central conductor cable 16 is described in this second illustrative method, more than one central conductor cable 16 can be used and the preformed sheet assembly 32 can be wrapped around more than one central conductor cable 16 in such as way as to define a cross section other than circular. For example, the sheet assembly 32 can be wrapped to form a substantially rectangular, square, triangular, elliptical, trapezoid and irregular cross-section to suit for different applications. When the sheet assembly 32 is wrapped around more than one central conductor cable 16, the total width of the contacting portions 44 of the first surface 34 of the sheet assembly 32 should be equal to the entire circumference defined by said more than one central conductor cable 16.

By using the first and second illustrative methods described herein, a core assembly 12 and thus the cable assembly 10 can be formed without using a tape, thereby reducing time and expenses for manufacturing the cable assembly. Additionally, since the insulating material 22 solidifies before the core assembly 12 is spooled onto a take-up drum, voids in the core assembly 12 can be eliminated, thereby improving compression resistance of the insulating material 22.

Cables of the invention generally include at least one core assembly including insulated conductors, and optionally at least one layer of armor wires, or other suitable strength member, surrounding the at least one core assembly. Any suitable metallic conductors may be used in the insulated conductors. Examples of metallic conductors include, but are not necessarily limited to, copper, nickel coated copper, or aluminum. Preferred metallic conductors are copper conductors. While any suitable number of metallic conductors may be used in forming the insulated conductor, preferably from 1 to about 60 metallic conductors are used, more preferably 7, 19, or 37 metallic conductors.

The metallic conductors may have a circular or ovate cross-sectional profile. In cases where the cabling electrical conductors with circular-profile stranded wire conductors does not provide optimum electrical performance, some or all of the metallic conductors may be shaped similar to the sector within which the metallic conductor is housed. For example, referring to FIG. 5, where the sector formed between two notches 42 is essentially trapezoidal in shape, the metallic conductor may have a trapezoidal shape.

Cables according to the invention may further include at least one armoring layer disposed adjacent the core assembly, and preferably an inner layer and an outer layer, or solely an outer layer. In some embodiments, the outer layer is formed of armor wires which are essentially circular in cross sectional profile, while in other cases, the armor wires may be shaped such that when secured in place, a substantially smooth outer cable surface is formed (these are termed shaped armor wires).

As described above, an outer armoring layer may be disposed adjacent the inner layer of armor wires. By "adjacent" it is meant that the layers are in close proximity, but may or may not be in physical contact, but does mean the absence of the same kind in between. The term "substantially smooth", as used above to describe the outer surface of a cable formed of strength members, means the outer circumferential surface is essentially smooth but may have interruptions or slight variations in shape primarily due to use of a plurality of strength members. Examples of such include, but are not necessarily limited to, gaps formed between individual strength members, the outer surfaces of neighboring members orientated in different planes, and the like. Also, a polymeric material may at least be partially or fully disposed in interstitial spaces formed between armor wires. When shaped armor wires are used to form the outer cable layer, any cross-sectional geometric shape which serves to maintain the position of the shaped armor wire within the layer of armor wires may be used. Examples of such shapes include, but are not limited to, trapezoidal, rhombic, triangular, square, keystone, oval, circular, concave, convex, rectangular, shield shapes, or any practical combination thereof. Armor wires used according to the invention may be generally made of any suitable material or materials, including high tensile strength materials including, but not necessarily limited to, galvanized improved plow steel, alloy steel, or the like, or even of a bimetallic composite. Alternatively, any individual armor wire, when used in cables of the invention, may be formed from a plurality of filaments bundled to form a strength member, which may further include a polymer jacket encasing the filaments.

Armor wires or shaped strength members useful for cable embodiments of the invention, may have bright, drawn high strength steel wires (of appropriate carbon content and strength for wireline use) placed at the core of the armor wires, and an alloy with resistance to corrosion is then clad over the core, which form a bimetallic wire or member. The corrosion resistant alloy layer may be clad over the high strength core by extrusion or by forming over the steel wire. The corrosion resistant clad may be from about 50 microns to about 600 microns in thickness. The material used for the corrosion resistant clad may be any suitable alloy that provides sufficient corrosion resistance and abrasion resistance when used as a clad. The alloys used to form the clad may also have tribological properties adequate to improve the abrasion resistance and lubricating of interacting surfaces in relative motion, or improved corrosion resistant properties that minimize gradual wearing by chemical action, or even both properties.

It should be noted that while the cable assembly 10 has been described as an electrical conductor cable for the purpose of transmitting electricity, the present disclosure can be used in a variety of cable constructions, including optical fiber containing cables.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A preformed sheet assembly adapted to surround a central conductor cable to form a core assembly of a cable assembly, comprising:

a plurality of outer conductor cables arranged side by side adjacent to each other; and an insulating material disposed around the outer conductor cables to enclose said plurality of outer conductor cables therein, the insulating material defining opposing first and second surfaces, the first surface contact the central conductor cable and the second surface forming an outer circumference of the core assembly.

2. The preformed sheet assembly according to claim 1, wherein the first surface defines a plurality of contacting portions and a plurality of notches arranged in an alternate manner.

3. The preformed sheet assembly according to claim 2, wherein the plurality of notches are formed between the adjacent two of the outer conductor cables.

4. The preformed sheet assembly according to claim 2, wherein the contacting portions and the notches are so constructed that the total width of the contacting portions is substantially equal to the outer circumference of the central conductor cable.

* * * * *